US005644933A

United States Patent [19]

Rathbone

[11] Patent Number: 5,644,933

[45] **Date of Patent: *Jul. 8, 1997**

[54] AIR SEPARATION

[75] Inventor: Thomas Rathbone, Farnham, England

[73] Assignee: The BOC Group plc, Windlesham, England

[ * ] Notice: The term of this patent shall not extend beyond the expiration date of Pat. No. 5,438,835.

[21] Appl. No.: 582,594

[22] Filed: Jan. 3, 1996

[30] Foreign Application Priority Data

Jan. 5, 1995 [GB] United Kingdom ..... 9500120

[51] Int. Cl.[6] ..... F25J 3/04

[52] U.S. Cl. ..... 62/646; 62/900; 62/902

[58] Field of Search ..... 62/646, 900, 902

[56] References Cited

U.S. PATENT DOCUMENTS

| | | | |
|---|---|---|---|
| 4,936,099 | 6/1990 | Woodward et al. | 62/646 |
| 5,006,137 | 4/1991 | Agrawal et al. | 62/646 |
| 5,069,699 | 12/1991 | Agrawal | 62/646 |
| 5,231,837 | 8/1993 | Ha | 62/646 |
| 5,257,504 | 11/1993 | Agrawal et al. | 62/646 |
| 5,341,646 | 8/1994 | Agrawal et al. | 62/900 X |
| 5,361,590 | 11/1994 | Rathbone | 62/646 |
| 5,438,835 | 8/1995 | Rathbone | 62/646 |

*Primary Examiner*—Christopher Kilner
*Attorney, Agent, or Firm*—David M. Rosenblum; Salvatore P. Pace

[57] ABSTRACT

A stream of compressed air is purified in a unit by removal of carbon dioxide and water vapour. The air is cooled by passage through a heat exchanger to a temperature suitable for its rectification. The air is separated in a higher pressure rectifier into oxygen-enriched liquid and nitrogen vapour. A stream of the oxygen-enriched liquid is reduced in pressure and introduced into a phase separator provided with a reboiler with the result that further separation takes place and a liquid further enriched in oxygen and an intermediate vapour are formed. A stream of the further-enriched liquid is separated into oxygen and nitrogen in a lower pressure rectifier. A stream of the intermediate vapour is condensed in a condenser and is introduced into the lower pressure rectifier. A part of the liquid nitrogen reflux for the higher and lower pressure rectifiers is formed by condensing nitrogen vapour separated in the higher pressure rectifier by indirect heat exchange with liquid from an intermediate mass transfer region the rectifier. Another part of the liquid nitrogen reflux is formed by vaporising impure oxygen product of the lower pressure rectifier in a condenser-reboiler by indirect heat exchange with nitrogen vapour taken from the lower pressure rectifier.

10 Claims, 1 Drawing Sheet

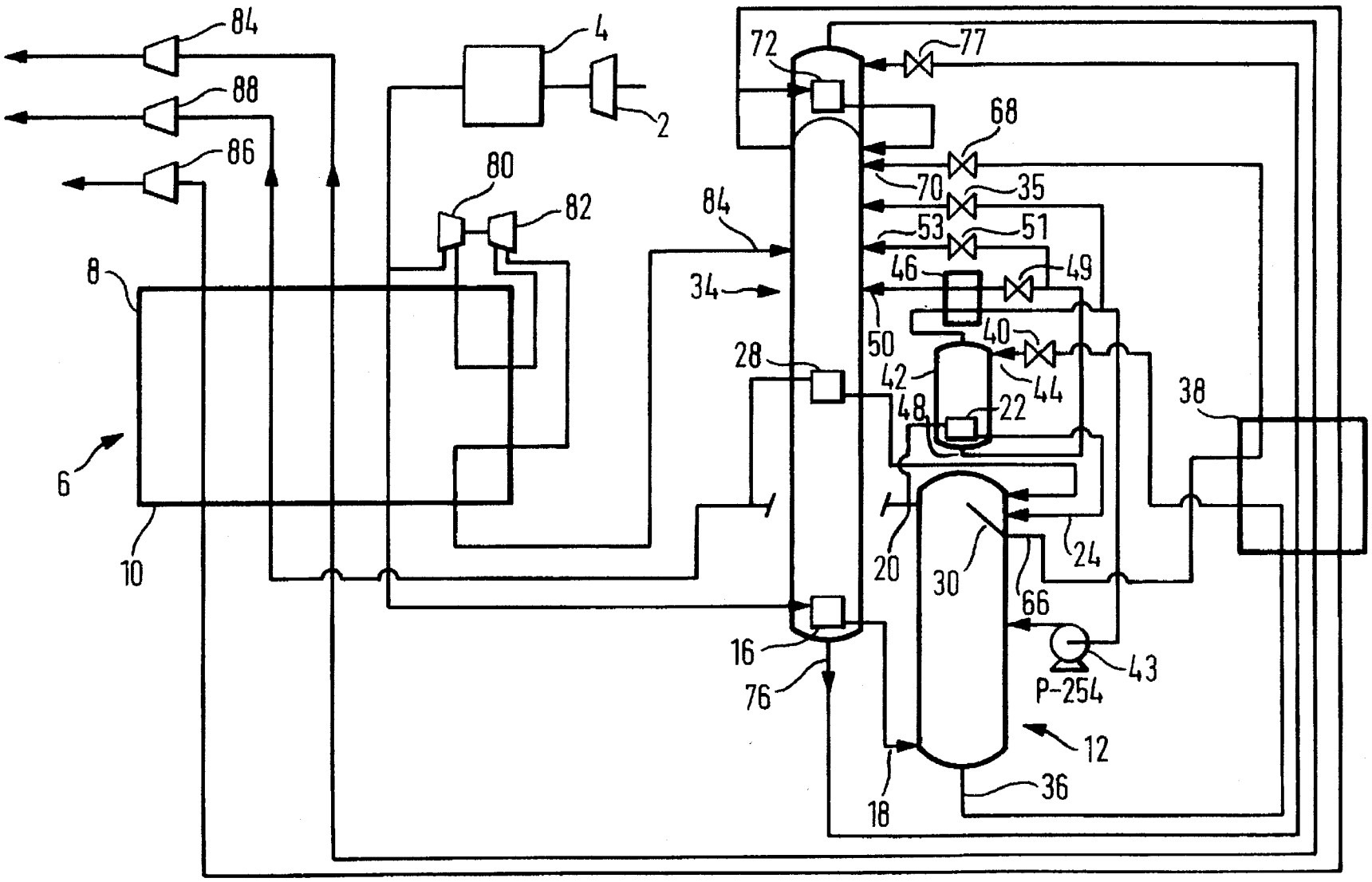
38
43
P-254
12
36
24
66
30
18
20
22
44
40
49
51
35
68
77
70
53
46
50
42
48
72
28
16
76
84
34
2
4
82
80
84
88
86
8
10
6

AIR SEPARATION

BACKGROUND OF THE INVENTION

This invention relates to a method and apparatus for separating air.

The most important method commercially of separating air is by rectification. The most frequently used air separation cycles include the steps of compressing a stream of air, purifying the resulting stream of compressed air by removing water vapour and carbon dioxide, and pre-cooling the stream of compressed air by heat exchange with returning product streams to a temperature suitable for its rectification. The rectification is performed in a so-called "double rectification column" comprising a higher pressure and a lower pressure rectification column i.e. one of the two columns operates at higher pressure than the other. Most if not all of the air is introduced into the higher pressure column and is separated into oxygen-enriched liquid air and liquid nitrogen vapour. The nitrogen vapour is condensed. A part of the condensate is used as liquid reflux in the higher pressure column. Oxygen-enriched liquid is withdrawn from the bottom of the higher pressure column, is sub-cooled, and is introduced into an intermediate region of the lower pressure column through a throttling or pressure reduction valve. The oxygen-enriched liquid is separated into substantially pure oxygen and nitrogen products in the lower pressure column. These products are withdrawn in the vapour state from the lower pressure column and form the returning streams against which the incoming air stream is heat exchanged. Liquid reflux for the lower pressure column is provided by taking the remainder of the condensate from the higher pressure cola, sub-cooling it, and passing it into the top of the lower pressure column through a throttling or pressure reduction valve.

Conventionally, the lower pressure column is operated at pressures in the range of 1 to 1.5 bar. (Unless stated to the contrary, all pressures given herein are absolute, and not gauge, pressures.) Liquid oxygen at the bottom of the lower pressure column is used to meet the condensation duty at the top of the higher pressure column. Accordingly, nitrogen vapour from the top of higher pressure column is heat exchanged with liquid oxygen in the bottom of the lower pressure column. Sufficient liquid oxygen is able to be evaporated thereby to meet the requirements of the lower pressure column for reboil and to enable a good yield of gaseous oxygen product to be achieved. The pressure at the top of the higher pressure column and hence the pressure to which the incoming air is compressed are arranged to be such that the temperature of the condensing nitrogen is a degree or two Kelvin higher than that of the boiling oxygen in the lower pressure column. In consequence of these relationships, it is not generally possible to operate the higher pressure column below a pressure of about 5 bar.

It is also possible to operate the lower pressure column at more elevated pressures. If the operating pressure of the lower pressure rectifier is so raised, there is a consequential increase in the pressure at which the higher pressure column is operated.

Improvements to the air separation process enabling pressure ratio between the higher pressure column and the lower pressure column have been proposed in order to produce an impure oxygen product, containing, say, from 3 to 20% by volume of impurities. U.S. Pat. No. 4,410,343 discloses that when such lower purity oxygen is required, rather than having the above-described link between the lower and higher pressure columns, air is employed to boil oxygen in the bottom of the lower pressure column in order both to provide reboil for that column and to evaporate the oxygen product. The resulting condensed air is then fed into both the higher pressure and the lower pressure columns. A stream of oxygen-enriched liquid is withdrawn from the higher pressure column, is passed through a throttling valve and a part of it is used to perform the nitrogen condensing duty at the top of the higher pressure column.

U.S. Pat. No. 3,210,951 also discloses a process for producing impure oxygen in which air is employed to boil oxygen in the bottom of the lower pressure column in order both to provide reboil for that column and to evaporate the oxygen product. In this instance, however, oxygen-enriched liquid from an intermediate region of the lower pressure column is used to fulfil the duty of condensing nitrogen vapour produced in the higher pressure column. This process is capable of reducing the operating pressure of the higher pressure column close to 4 bar.

The methods disclosed in U.S. Pat. No. 3,210,951 and U.S. Pat. No. 410,343 become less suitable for use if the lower pressure column is to be operated at a pressure in excess of about 1.5 bar.

EP-A-0,538,118 discloses a method of operating a double column process above the conventional pressure limits without loss of oxygen recovery and with improvements in power consumption. In one example, oxygen-enriched liquid air is taken from the bottom of the higher pressure rectification column and is introduced into a further column at a level above all the liquid-vapour mass exchange surfaces therein. The further column operates at pressures intermediate those in the higher pressure column and those in the lower pressure column. The further column provides a liquid feed and a vapour feed to intermediate levels of the lower pressure rectification column.

Our European patent application 94302953.8 to be published on 11 Jan. 1995 under the number EP-A-0,633,438 discloses with reference to its FIG. 2 a process broadly similar to that shown in the drawing accompanying this application save that the impure oxygen product is vaporised by heat exchange with nitrogen withdrawn from the higher pressure rectification column. A disadvantage of this arrangement is that if the process is operated at a pressure in the lower pressure rectifier much above 5 bar the product recovery (i.e. the yield of oxygen) falls. There is an increasing demand for high pressure nitrogen product in so-called integrated gasification-combined cycle (IGCC) processes, the nitrogen being supplied to the combustion chamber or expander of a gas turbine which generates power by combustion of a fuel gas which is a product of the gasification. The oxygen product of the air separation is itself used as a reactant in the generation of the fuel gas. It is therefore advantageous to operate the lower pressure rectifier at pressures in the range of, say, 5 to 10 bar without there being a reduction in the yield of oxygen.

The present invention aims at providing a method and apparatus which are able to achieve this advantage.

SUMMARY OF THE INVENTION

According to the present invention there is provided a method of separating air, comprising the steps of:

a) separating pre-cooled and purified air in a higher pressure rectifier into oxygen-enriched liquid and nitrogen vapour;

b) separating a stream of the oxygen-enriched liquid at a pressure between the pressure at the top of the higher pressure rectifier and that at the bottom of a lower pressure rectifier so as to form a liquid further enriched in oxygen and an intermediate vapour;

c) separating a stream of the further-enriched liquid in the lower pressure rectifier into oxygen and nitrogen;

d) providing liquid nitrogen reflux for the higher and lower pressure rectifiers; and e) condensing a stream of the intermediate vapour and introducing at least a part of the resulting condensate into the lower pressure rectifier;

wherein a part of the liquid nitrogen reflux is formed by condensing a stream of said nitrogen vapour by indirect heat exchange with liquid from an intermediate mass transfer region of the lower pressure rectifier, and another part of said liquid nitrogen reflux is formed by vaporising impure oxygen product of the lower pressure rectifier in indirect heat exchange with vaporous nitrogen product of the lower pressure rectifier.

The invention also provides apparatus for separating air, comprising:

a) a higher pressure rectifier for separating pre-cooled and purified air into oxygen-enriched liquid and nitrogen vapour;

b) a lower pressure rectifier for producing oxygen and nitrogen;

c) means for separating a stream of the oxygen-enriched liquid at a pressure between the pressure at the top of the higher pressure rectifier and that at the bottom of the lower pressure rectifier so as to form a liquid further enriched in oxygen and an intermediate vapour;

d) means for introducing a stream of the further-enriched liquid into the lower pressure rectifier for separation into oxygen and nitrogen;

e) a first condenser for condensing a stream of said intermediate vapour, said first condenser having an outlet for resulting condensate in communication with the lower pressure rectifier; and f) means for providing liquid nitrogen reflux for the higher and lower pressure rectifiers including a second condenser for indirectly heat exchanging a stream of said nitrogen vapour with liquid from an intermediate mass transfer region of the lower pressure rectifier, and a third condenser for vaporising impure liquid product of the lower pressure rectifier by indirect heat exchange with a condensing vaporous product of the lower pressure rectifier.

Since the intermediate vapour typically contains more than 80% by volume of nitrogen, introduction of said part of said condensate into the lower pressure rectifier can be employed to counteract a tendency for there to be a shortage of reflux in the lower pressure rectifier at elevated lower pressure rectifier operating pressures. Such shortage of reflux tends, as noted above, to become particularly marked at lower pressure rectifier operating pressures above 5 bar. In accordance with the invention, however, some of the liquid nitrogen reflux for the lower pressure rectifier is formed by vaporising oxygen product withdrawn from the lower pressure rectifier in indirect heat exchange with nitrogen vapour product of the lower pressure rectifier. More liquid nitrogen reflux is made available to the lower pressure rectifier than it would be if the source of the vaporising fluid were the top of the higher pressure rectifier. This is because in the latter example, some of the resulting nitrogen condensate would need to be returned to the higher pressure rectifier to serve as reflux therein, thereby reducing the proportion of this nitrogen condensate available to the lower pressure rectifier.

The separation of the stream of the said oxygen enriched liquid in step (b) of the method according to the invention is performed either by (i) rectification in a further rectifier (sometimes referred to hereinafter as "intermediate rectification") or by (ii) flashing the stream of oxygen-enriched liquid to form a liquid-vapour mixture at said pressure between the pressure at the top of the higher pressure rectifier and that at the bottom of the lower pressure rectifier; and separating the resulting liquid-vapour mixture into liquid and vapour phases to form the further enriched liquid and the intermediate vapour, these steps sometimes being referred to collectively as "intermediate flash separation". In order to enhance the rate of formation of the intermediate vapour a part of the further enriched liquid is preferably reboiled.

If step (b) of the method according to the invention is performed by intermediate rectification, the stream of oxygen-enriched liquid is preferably introduced below all liquid-vapour mass exchange means in the further rectifier. Reboiling of part of this liquid is preferably performed by indirect heat exchange with another stream of nitrogen from the higher pressure rectifier, the nitrogen thereby being condensed. (The nitrogen condensate provides a further source of reflux which is preferably employed in the higher pressure rectifier.) The further rectifier is therefore preferably provided with a reboiler so as partially to reboil liquid at the bottom of the further rectifier. The further rectifier preferably produces, as the intermediate vapour, nitrogen.

If step (b) of the method according to the invention is performed by intermediate flash separation, the partial reboiling may be performed upstream of or in the phase separator. The partial reboiling may be performed by indirect heat exchange with another stream of nitrogen vapour from the higher pressure rectifier, the nitrogen thereby being condensed. The nitrogen condensate provides a further source of reflux for the higher pressure rectifier and/or lower pressure rectifier.

Irrespective of how step (b) is performed, condensation of the intermediate vapour is preferably performed by indirect heat exchange with a stream of said further-enriched liquid, which stream is reduced in pressure upstream of the heat exchange. The stream of said further-enriched liquid is typically partially vaporised thereby and the resulting fluid is preferably introduced into the lower pressure rectifier. (If desired, a stream of further-enriched liquid may be introduced into the lower pressure rectifier, by-passing the indirect heat exchange with the intermediate vapour.) Alternatively, the intermediate vapour may be condensed by indirect heat exchange with liquid taken from an intermediate mass transfer region of the lower pressure rectifier, the liquid taken from the intermediate mass transfer region of the lower pressure rectifier thereby being at least partially reboiled. It is preferably returned to a mass transfer region of the lower pressure rectifier.

Typically, reboil for the bottom of the lower pressure rectifier is provided by indirect heat exchange in a reboiler-condenser with a stream of pre-cooled and purified feed air, the feed air stream thereby being at least partially condensed.

The higher pressure rectifier and further rectifier preferably each comprise a rectification column. The lower pressure rectifier may also comprise a single rectification column, or may comprise two separate columns. The latter arrangement offers the advantage that the second condenser for indirectly heat exchanging a stream of said nitrogen vapour with liquid from an intermediate mass transfer region of the lower pressure rectifier may be located in a bottom region of one column and may therefore be a condenser-reboiler of the conventional thermo-siphon kind.

The oxygen separated in the lower pressure rectifier is preferably from 85 to 96% pure. The nitrogen separated in the lower pressure rectifier is preferably at least 98% pure.

BRIEF DESCRIPTION OF THE DRAWINGS

Refrigeration for the method according to the invention may be created by expansion with the performance of external work of a stream of either the feed air or a nitrogen stream.

The method and apparatus according to the invention will now be described by way of example with reference to the accompanying drawing which is a schematic flow diagram of an air separation plant according to the invention;

The drawing is not to scale.

DETAILED DESCRIPTION

Referring to the drawing, a feed air stream is compressed in a compressor 2 and the resulting compressed feed air stream is passed through a purification unit 4 effective to remove water vapour and carbon dioxide therefrom. The compressor 2 typically forms part of a gas turbine (not shown), in which example the feed air stream forms only a small part of the output of the compressor 2, and is cooled to about ambient temperature in a separate heat exchanger (not shown) upstream of the purification unit 4.

The unit 4 employs beds (not shown) of adsorbent to effect the removal of water vapour and carbon dioxide and other impurities such as hydrocarbons. The beds are operated out of sequence with one another such that while one or more beds are purifying the feed air stream the remainder are being regenerated, for example by being purged with a stream of hot nitrogen. Such a purification unit and its operation are well known in the art and need not be described further.

The purified feed air stream is divided into first and second air streams. The first air stream flows through a main heat exchanger 6 from its warm end 8 to its cold end 10 and is thereby cooled from about ambient temperature to its saturation temperature (or other temperature suitable for its separation by rectification). The cooled first air stream partially condensed by passage through the condensing passages of a condenser-reboiler 16. The resulting partially condensed air is introduced into a higher pressure rectification column 12 through an inlet 18. The higher pressure rectification column 12 contains liquid-vapour contact means (not shown) whereby a descending liquid phase is brought into intimate contact with an ascending vapour phase such that mass transfer between the two phases takes place.

The descending liquid phase becomes progressively richer in oxygen and the ascending vapour phase progressively richer in nitrogen. The liquid-vapour contact means may comprise an arrangement of liquid-vapour contact trays and associated downcomers or may comprise a structured or random packing. A volume (not shown) of oxygen-enriched liquid air typically collects at the bottom of the higher pressure rectification column 12.

A sufficient number of trays or a sufficient height of packing is included as the liquid-vapour contact means (not shown) for the vapour fraction passing out of the top of the liquid-vapour contact means to be essentially pure nitrogen. A stream of the nitrogen vapour is withdrawn from the top of the higher pressure rectification column 12 through an outlet 20 and is condensed in another reboiler-condenser 22. The condensate is returned to a collector 30 at the top of the higher pressure rectification column 12 through an inlet 24. Another stream of the nitrogen vapour is withdrawn from the top of the higher pressure rectification column 12 and is condensed in a yet further condenser-reboiler 28. The condensate is returned from the condenser-reboiler 28 to the collector 30. A part of the liquid nitrogen entering the collector 30 is used as liquid nitrogen reflux in the higher pressure rectification column 12; another part of the condensate is, as will be described below, used as liquid reflux in a lower pressure rectifier (i.e. rectification column) 34.

A stream of oxygen-enriched liquid (typically containing from 30 to 35% by volume of oxygen) is withdrawn from the bottom of the higher pressure rectification column 12 through an outlet 36 and is sub-cooled in a heat exchanger 38. The sub-cooled oxygen-enriched liquid stream is flashed through a first pressure reducing valve 40 and a resulting mixture of a flash gas depleted of oxygen ("the intermediate vapour") and a residual liquid further enriched in oxygen is formed. The mixture of further-enriched liquid and the intermediate vapour is introduced into a phase separator 42 through an inlet 44. Phase separator 42 could be replaced by an intermediate rectification column in which liquid were introduced into a bottom or top region thereof. The phase separator 42 houses the condenser-reboiler 28 which is situated so as to boil a part of the liquid phase. This reboiling enhances the rate of formation of the intermediate vapour. Another condenser-reboiler 46 condenses vapour taken from the top of the phase separator 42. A part of the resulting condensate is introduced into the lower pressure rectifier 34 via a throttling valve 35 as a first stream for separation therein. Another part of the resulting condensate is returned to an intermediate mass transfer region of the higher pressure rectification column 12 by a pump 43.

A stream of residual further-enriched liquid (typically containing about 40% by volume of oxygen) is continuously withdrawn from the bottom of phase separator 42 through an outlet 48 and one part of it is passed through a throttling or pressure reducing valve 49 so as to reduce its pressure to approximately the operating pressure of the lower pressure rectifier 34. The resultant pressure-reduced further-enriched liquid (typically containing some vapour) flows through the condenser-reboiler 46, thereby providing cooling for the condensation of the nitrogen vapour therein. The stream of further-enriched liquid is itself at least partially vaporised in the condenser-reboiler 46. The resulting oxygen-enriched stream is introduced into the lower pressure rectifier 34 as a second feed stream at an intermediate level through an inlet 50. As a third feed stream, the remainder of the further-enriched liquid oxygen is reduced in pressure by passage through a throttling valve 51 and is introduced into the lower pressure rectifier 34 through an inlet 53 at a level above that of the inlet 50.

The refrigeration demands of the plant shown in the drawing are met by taking the second stream of purified air from the purification unit 4 and further compressing it in a compressor 80. The compressed second stream of air is cooled to a temperature intermediate those of the cold end 10 and warm end 8 of the heat exchanger 6 by passage therethrough cocurrently with the first stream of air. The second air stream is withdrawn from an intermediate region of the main heat exchanger 6 and is expanded with the performance of external work in an expansion turbine 82. The resulting expanded stream of air is returned to the heat exchanger 6 and is further reduced in temperature by passage therethrough. The expanded second stream of air passes out of the cold end 10 of the heat exchanger 6 and is introduced into the lower pressure rectifier 34 through an inlet 84 as a fourth feed stream which is separated with the other three feed streams.

Separation of the four feed streams in the lower pressure rectifier 34 results in the formation of oxygen and nitrogen products. The lower pressure rectifier 34 contains liquid-vapour contact means (not shown) whereby a descending liquid phase is brought into intimate contact with an ascending vapour phase such that mass transfer between the two phases takes place. The liquid-vapour contact means (not shown) may be of the same kind as or a different kind from the liquid-vapour contact means used in the higher pressure rectification column 12. Liquid nitrogen reflux for the lower pressure rectifier 34 is provided from two sources. The first source is an outlet 66 from the collector 30. A stream of liquid nitrogen is withdrawn from the collector 30 and is sub-cooled in the heat exchanger 38. The sub-cooled liquid nitrogen stream passes through a pressure reducing valve 68 and flows into a top region of the lower pressure rectifier 34 through an inlet 70. A second stream of liquid nitrogen reflux is formed by withdrawing a stream of nitrogen vapour from the top of the lower pressure rectifier 34, condensing the stream in a condenser-reboiler 72 and returning the resultant nitrogen condensate to the top of the rectifier 34. A downward flow of liquid through the lower pressure rectifier 34 is thereby created. An upward flow of vapour through the lower pressure rectifier 34 is created by operation of the condenser-reboiler 16 to reboil liquid at the bottom of the rectifier. Flow of vapour through an upper region of the lower pressure rectifier 34 is enhanced by operation of the condenser-reboiler 22 to reboil liquid an intermediate level of the rectifier 34.

An oxygen product, typically from 90 to 95% pure, is withdrawn from a bottom region of the lower pressure rectifier 34 through an outlet 76. This product oxygen stream is sub-cooled by passage through the heat exchanger 38. The product oxygen stream is passed through a throttling valve 77 and is vaporised in the condenser-reboiler 72. Resultant oxygen vapour is warmed by passage through, firstly, the heat exchanger 38 and, secondly, the main heat exchanger 6 from its cold end 10 to its warm end 8. The resultant oxygen product, at approximately ambient temperature, may be compressed in a compressor 84 to a pressure suitable for a gasification reaction. A product gaseous nitrogen stream is withdrawn from the top of the lower pressure rectifier 34. It flows through the heat exchanger 38 thereby providing cooling for the sub-cooling of the other streams flowing therethrough. From the heat exchanger 38 the nitrogen flows through the heat exchanger 6 from its cold end 10 to its warm end 8 and leaves the heat exchanger 6 at approximately ambient temperature. It may be compressed in a compressor 86 to a pressure in the range of 15 to 20 bar and introduced into the combustion chamber (not shown) of a gas turbine.

In addition, a gaseous nitrogen product at elevated pressure may be withdrawn from the top of the higher pressure rectification column 12 and warmed to ambient temperature by passage through the main heat exchanger 6 from its cold end 10 to its warm end 8. This nitrogen product may be further compressed in a compressor 88. It is a significant advantage of the plant shown in the drawing that adequate reflux can be provided for the lower pressure rectifier 34 even though the rectifier 34 is operated at 6 bar and up to 20% of the nitrogen product is taken from the higher pressure rectification column 12.

In a typical example of the operation of the plant shown in the drawing, the higher pressure column 12 is operated at a pressure of about 13.5 bar, the lower pressure rectifier 34 at a pressure of about 6 bar, the phase separator 42 at a pressure of about 9 bar, and the condenser-reboiler 72 at a pressure of about 1.8 bar.

I claim:

1. A method of separating air, comprising the steps of:

a) separating pre-cooled and purified air in a higher pressure rectifier into oxygen-enriched liquid and nitrogen vapour;

b) separating a stream of the oxygen-enriched liquid by rectification within a further rectifier at a pressure between the pressure at the top of the higher pressure rectifier and that at the bottom of a lower pressure rectifier so as to form a liquid further enriched in oxygen and an intermediate vapour, the liquid further enriched in oxygen being partially reboiled by indirect heat exchange with another stream of nitrogen from the higher pressure rectifier;

c) separating a stream of the further-enriched liquid in the lower pressure rectifier into oxygen and nitrogen;

d) providing liquid nitrogen reflux for the higher and lower pressure rectifiers; and e) condensing a stream of the intermediate vapour and introducing at least a part of the resulting condensate into the lower pressure rectifier;

f) a part of the liquid nitrogen reflux being formed by condensing a stream of said nitrogen vapour by indirect heat exchange with liquid from an intermediate mass transfer region of the lower pressure rectifier;

g) another part of said liquid nitrogen reflux being formed by vaporising impure oxygen product of the lower pressure rectifier in indirect heat exchange with vaporous nitrogen product of the lower pressure rectifier.

2. The method as claimed in claim 1 in which the intermediate vapour is nitrogen.

3. A method of separating air, comprising the steps of:

a) separating pre-cooled and purified air in a higher pressure rectifier into oxygen-enriched liquid and nitrogen vapour;

b) separating a stream of the oxygen-enriched liquid at a pressure between the pressure at the top of the higher pressure rectifier and that at the bottom of a lower pressure rectifier so as to form a liquid further enriched in oxygen and an intermediate vapour, the stream of oxygen-enriched liquid being separated by flashing the stream of oxygen-enriched liquid to form a liquid-vapour mixture at said pressure between the pressure at the top of the higher pressure rectifier and that at the bottom of the lower pressure rectifier and separating the resulting liquid-vapour mixture into liquid and vapour phases to form the liquid further enriched enriched in oxygen liquid and the intermediate vapour, the liquid further enriched in oxygen being partially reboiled;

c) separating a stream of the further-enriched liquid in the lower pressure rectifier into oxygen and nitrogen;

d) providing liquid nitrogen reflux for the higher and lower pressure rectifiers; and e) condensing a stream of the intermediate vapour and introducing at least a part of the resulting condensate into the lower pressure rectifier;

f) a part of the liquid nitrogen reflux being formed by condensing a stream of said nitrogen vapour by indirect heat exchange with liquid from an intermediate mass transfer region of the lower pressure rectifier;

g) another part of said liquid nitrogen reflux being formed by vaporising impure oxygen product of the lower pressure rectifier in indirect heat exchange with vaporous nitrogen product of the lower pressure rectifier.

4. The method as claimed in claim 3, wherein the partial reboiling is performed by indirect heat exchange with another stream of nitrogen vapour from the higher pressure rectifier, the nitrogen thereby being condensed.

5. The method as claimed in claim 1 or claim 3, wherein the condensation of the intermediate vapour is performed by indirect heat exchange with a stream of said further-enriched liquid, which stream is reduced in pressure upstream of the heat exchange.

6. The method as claimed in claim 1 or claim 3, in which reboil for the bottom of the lower pressure rectifier is provided by indirect heat exchange in a reboiler-condenser with a condensing stream of pre-cooled and pitied feed air.

7. The method as claimed in claim 1 or claim 3 in which the oxygen separated in the lower pressure rectifier is from 85 to 96% pure.

8. An apparatus for separating air, comprising:

a) a higher pressure rectifier for separating pre-cooled and purified air into oxygen-enriched liquid and nitrogen vapour;

b) a lower pressure rectifier for producing oxygen and nitrogen;

c) a further rectifier for separating a stream of the oxygen-enriched liquid so as to form a liquid further enriched in oxygen and an intermediate vapor;

d) a pressure reduction valve interposed between said further rectifier and said higher pressure column so that said oxygen-enriched liquid is separated at a pressure between the pressure at the top of the higher pressure rectifier and that at the bottom of the lower pressure rectifier;

e) a reboiler connected to the higher pressure rectifier and configured for partially reboiling said liquid further enriched in oxygen by indirect heat exchange with another stream of nitrogen from said higher pressure rectifier;

f) means for introducing a stream of the further-enriched liquid into the lower pressure rectifier for separation into oxygen and nitrogen;

g) a first condenser for condensing a stream of said intermediate vapour, said first condenser having an outlet for resulting condensate in communication with the lower pressure rectifier; and h) means for providing liquid nitrogen reflux for the higher and lower pressure rectifiers including a second condenser for indirectly heat exchanging a stream of said nitrogen vapour with liquid from an intermediate mass transfer region of the lower pressure rectifier, and a third condenser for vaporising impure liquid product of the lower pressure rectifier by indirect heat exchange with a condensing vaporous product of the lower pressure rectifier.

9. An apparatus for separating air, comprising:

a) a higher pressure rectifier for separating pre-cooled and purified air into oxygen-enriched liquid and nitrogen vapour;

b) a lower pressure rectifier for producing oxygen and nitrogen;

c) a phase separator connected to the higher pressure column and a pressure reduction valve interposed between said phase separator and said high pressure column for separating a stream of the oxygen-enriched liquid at a pressure between the pressure at the top of the high pressure rectifier and that at the bottom of the lower pressure rectifier by flashing the stream of oxygen-enriched liquid to form a liquid-vapour mixture at said pressure and separating the resulting liquid-vapour mixture into liquid and vapour phases to form a liquid further enriched enriched in oxygen and an intermediate;

d) a reboiler connected to the higher pressure rectifier and configured for partially reboiling said liquid further enriched in oxygen by indirect heat exchange with another stream of nitrogen from said higher pressure rectifier;

e) means for introducing a stream of the further-enriched liquid into the lower pressure rectifier for separation into oxygen and nitrogen;

f) a first condenser for condensing a stream of said intermediate vapour, said first condenser having an outlet for resulting condensate in communication with the lower pressure rectifier; and g) means for providing liquid nitrogen reflux for the higher and lower pressure rectifiers including a second condenser for indirectly heat exchanging a stream of said nitrogen vapour with liquid from an intermediate mass transfer region of the lower pressure rectifier, and a third condenser for vaporising impure liquid product of the lower pressure rectifier by indirect heat exchange with a condensing vaporous product of the lower pressure rectifier.

10. The apparatus as claimed in claim 8 or claim 9, additionally including a reboiler-condenser, associated with the bottom of the lower pressure rectifier, having its condensing passages in communication with a source of a stream of pre-cooled, purified, air.

* * * * *